US006108268A

United States Patent [19]

Moss

[11] Patent Number: 6,108,268

[45] Date of Patent: Aug. 22, 2000

[54] IMPEDANCE MATCHED JOINED DRILL PIPE FOR IMPROVED ACOUSTIC TRANSMISSION

[75] Inventor: William C. Moss, San Mateo, Calif.

[73] Assignee: The Regents of the University of California, Oakland, Calif.

[21] Appl. No.: 09/005,494

[22] Filed: Jan. 12, 1998

[51] Int. Cl.[7] ..... F16L 9/14

[52] U.S. Cl. ..... 367/82; 367/83; 439/192; 439/194; 340/854.4; 175/56

[58] Field of Search ..... 367/82, 83, 33, 367/152; 340/854.3, 854.11; 166/73; 175/56; 439/192, 194; 73/632, 644

[56] References Cited

U.S. PATENT DOCUMENTS

| | | | |
|---|---|---|---|
| 3,252,225 | 5/1966 | Hixon | 367/82 |
| 4,293,936 | 10/1981 | Cox | 367/82 |
| 4,314,365 | 2/1982 | Peterson | 367/82 |
| 4,562,559 | 12/1985 | Sharp | 367/82 |
| 5,222,049 | 6/1993 | Drumheller | 367/82 |
| 5,274,606 | 12/1993 | Drumheller | 367/82 |
| 5,283,768 | 2/1994 | Rorden | 367/83 |

*Primary Examiner*—Brian Zimmerman
*Assistant Examiner*—Albert K. Wong
*Attorney, Agent, or Firm*—L. E. Carnahan; Alan H. Thompson

[57] ABSTRACT

An impedance matched jointed drill pipe for improved acoustic transmission. A passive means and method that maximizes the amplitude and minimize the temporal dispersion of acoustic signals that are sent through a drill string, for use in a measurement while drilling telemetry system. The improvement in signal transmission is accomplished by replacing the standard joints in a drill string with joints constructed of a material that is impedance matched acoustically to the end of the drill pipe to which it is connected. Provides improvement in the measurement while drilling technique which can be utilized for well logging, directional drilling, and drilling dynamics, as well as gamma-ray spectroscopy while drilling post shot boreholes, such as utilized in drilling post shot boreholes.

25 Claims, 5 Drawing Sheets

IMPEDANCE MATCHED JOINED DRILL PIPE FOR IMPROVED ACOUSTIC TRANSMISSION

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to measurement while drilling systems, particularly to maximizing the amplitude and minimizing the temporal dispersion of acoustic signals sent through a drill string, and more particularly to impedance matched jointed drill pipe for improved acoustic transmission.

Borehole logging tools are used to obtain information about the state of the borehole and the nature of the geologic structures in the vicinity of the borehole. The information can be transmitted to the surface by attaching the logging tool to an electrical cable and lowering the tool downhole. Although this method has the advantage of high rates of data transmission, it is necessary to suspend drilling operations while the borehole is logged. The downtime is extremely expensive, so the frequency of logging must be chosen judiciously. If the logging tool is being used to locate strata of oil, gas, etc., then extra expense could be incurred by drilling beyond the strata, due to the sparse logging frequency. A system that can perform measurements while drilling (MWD) is extremely desirable and profitable (time and money wise). High data rate MWD would allow real-time directional drilling and even more important, real-time drilling dynamics (vibration, bit-wear, torque-and weight-on-bit), both of which cannot be done with the current low data rate (MWD) technology. This low data rate MWD technology uses pressure pulses in the drilling mud to transmit acoustic signals from the logging tool to the surface. However, the maximum data transmission rate is about 7 bits per second, which is too slow for most applications. Higher rates are precluded by attenuation in the drilling mud. Another MWD arrangement that has received attention over the past forty years uses the acoustic properties of the drill string to transmit data. The drill string does not attenuate acoustic waves as readily as the mud, so that transmission rates of 30 bits per second or more are possible theoretically. The main impediments (past and present) to commercialization of a system that uses the drill string for data transmission are noise, echoes, and obtaining sufficient power downhole to power the acoustic transmitter.

A typical drill string consists of sections of hollow steel pipe, e.g., 30 feet long, connected by short, e.g. 18 inch long sections of pipe called joints. The acoustical impedances of the pipes and joints differ, due to their different cross-sectional areas, densities, and sound speeds. These acoustical impedance mismatches make the drill string act as bandpass filter; more precisely, a "comb" filter composed of a frequency dependent series of passbands and stopbands. See D. Drumheller, Acoustical Properties Of Drill Strings, J. Acoust. Soc. Am., 85, 1048 (1989). Acoustic energy can be propagated only at frequencies located within the passbands. The passbands change as the drill string wears. The goal is to transmit to the surface interpretable data acquired by a logging tool at depth. Various prior efforts have been directed to arrangements for data transmission, but none have been commercialized. These prior efforts are exemplified by U.S. Pats. No. 3,252,225 issued 1966 to C. W. Peterson et al.; U.S. Pat. No. 4,293,936 issued 1981 to W. H. Cox et al.; and U.S. Pat. No. 4,562,559 issued 1985 to H. E. Sharp et al.

The present invention is directed to increasing significantly signal-to-noise ratios in a drill string, thus decreasing the amount of power necessary to send acoustic signals. Consequently, signals can be propagated over much greater distances with less attenuation. The present invention also reduces the dispersion of the transmitted signals, which raises the rate of data transmission. This is accomplished by impedance matching the drill pipes and the joints interconnecting the pipes. Thus, this invention represents a primary component for developing a commercially viable high data rate MWD system.

SUMMARY OF THE INVENTION

It is an object of the present invention to provide improved acoustic transmission for a measurement while drilling system.

A further object of the invention is to provide an impedance matched jointed drill pipe for improved acoustic transmission.

Another object of the invention is to provide a passive method for maximizing the amplitude and minimizing the temporal dispersion of acoustic signals that are sent through a drill string.

Another object of the invention is to provide a high data rate measurement while drilling system.

Another object of the invention is to provide an acoustically matched joint for hollow pipes.

Another object of the invention is to impedance match a joint to whatever it is connected.

Another object of the invention is to provide a pipe string made out of material that is impedance matched to the joints.

Another object of the invention is to improve signal transmission through a drill string by replacing the standard joints in the drill string with joints constructed of a material that is impedance matched acoustically to the end of the drill pipe to which it is connected.

Other objects and advantages of the present invention will become apparent from the following description and accompanying drawings. The invention involves an impedance matched jointed drill pipe for improved acoustic transmission. The invention involves a method to increase significantly signal-to-noise ratios, thus decreasing the amount of power necessary to send acoustic signals. Consequently, signals can be propagated over much greater distances with less attenuation. The method of this invention also reduces the dispersion of the transmitted signals, which raises the rate of data transmission. Thus, this invention provides the primary component for developing a viable high data rate measurement while drilling (MWD) system. The improvement in signal transmission realized by the present invention is accomplished by replacing the standard joints in a drill string with mating threaded joints on the ends of the pipes or with joints constructed of a material that is impedance matched acoustically to the end of the drill pipe to which it is secured, as by threaded connection or welding or attaching with adhesives such as epoxy. By way of example, joints containing alloys of titanium or aluminum have been experimentally verified to have thermal, mechanical, and machinability/bonding properties that are compatible with conventional steel drilling pipe. A signal in the impedance matched pipe string has more than twice the amplitude and less than half of the temporal duration than the standard (unmatched) pipe string.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

The present invention relates to an impedance matched jointed drill string and a passive method that will maximize the amplitude and minimize the temporal dispersion of acoustic signals that are sent through a drill string, for use in a measurement while drilling telemetry system. The improvement in signal transmission is realized by replacing the standard joints in a drill string with joints constructed of a material that is impedance matched acoustically to the end of the drill pipe to which it is secured or connected, such as being welded, threaded, or epoxied (glued). Thus, the present invention involves an impedance matched jointed drill pipe for improved acoustic transmission. The present invention provides a primary component for developing a commercially viable high data rate measurement while drilling (MWD) system. This is accomplished by increasing significantly signal-to-noise ratios, thus decreasing the amount of power necessary to send acoustic signals through a drill string and increasing the distance between acquiring and retransmission of the signal. This invention also reduces the dispersion of the transmitted signals, which raises the rate of data transmission.

When acoustic waves travel through the solid sections of the drill string, reflections occur whenever a change in acoustical impedance (density×solid area×sound speed) is encountered. If the joints and pipes are manufactured from the same material, then only changes in the solid area cause reflections. The key feature of the present invention is to impedance match a joint to whatever it is connected to, and is particularly adapted for joining sections of pipe, such as in a conventional drill string, wherein the joint is welded, threaded, or epoxied to ends of adjoining pipes, commonly referred to as the upset region.

The present invention may be utilized in various applications involving transmission of acoustical signals through interconnected members, but has particular application in the measurement while drilling technology utilized in borehole logging of drilled holes, directional drilling, drilling dynamics, as well as for applications such as gamma-ray spectroscopy while drilling boreholes of various types.

Figure 1A:
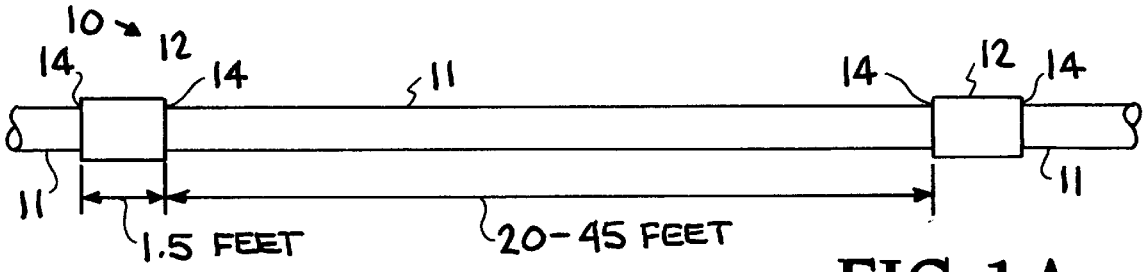
FIG. 1A is a schematic illustration of a few sections of a conventional jointed drill string.
Figure 1B:
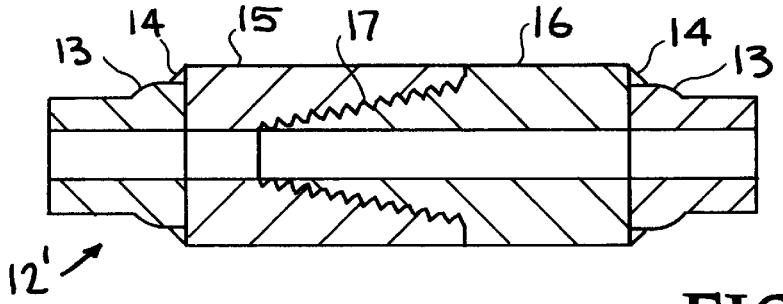
FIG. 1B illustrates in cross-section an enlarged joint of the drill string of FIG. 1.

The general picture of a drill string, such as illustrated in FIG. 1A is that of lengths of thin-walled pipe connected together by thicker walled joints. Each joint consists of two pieces, as shown in FIG. 1B, with male and female screw (threaded) connections. The joint is thick to allow for a strong screw connection and is either screwed or welded to ends of adjacent pipes. In either case, standard pipe wall is typically too thin to allow direct connection to the joint. Therefore, there is a region at the ends of the pipe, referred to as an upset, generally about 4 inches, depending on the pipe and joint, along whose length there is a variable wall thickness. The upsets or thickening of the ends of the pipe provides enough pipe material to allow the joint to be welded or screwed to it, typically welded.

For a drill string consisting of only 1 material, steel for example, an acoustic wave traveling along the length of the pipe sees an impedance change whenever there is an area change, i.e., pipe-to-upset, upset-to-joint, joint-to-upset, and upset-to-pipe, for each jointed connections in a pipe string. There are a multitude of designs for pipes, upsets, and joints.

If the drill string consists of a series of pipes (all made of the same material), which when screwed together looked no different to an acoustic wave than a long single piece of pipe, an acoustic wave would travel without reflection along the entire length of the pipe. But, it takes a pipe with a cross-section similar to the joint to make a mechanically strong screw connection. Making the entire drill string of steel pipe of this thickness would be costly, and the weight would be enormous. Thus, the joints are thick, to give the necessary strength for the connections, and the pipes are as thin as they can be, for weight and cost reasons.

The key point of the present invention is to impedance match the joint to whatever it is connected.

The method and an apparatus for carrying out the method in accordance with the present invention is described hereafter in conjunction with FIGS. 1A–1B, 2A–2D, 3A–3B, 4A–4B, 5A–5B, and 6.

FIG. 1A illustrates a typical drill string generally indicated at 10 which comprises a plurality of conventional hollow pipes 11 (three shown) connected by conventional hollow joints 12 (two shown). For example, the conventional pipes 11 may each be of a standard 30 foot length, 3.8 inch internal diameter, 4.5 external diameter pipe typically constructed of steel, with an upset or enlarged ends 13, (FIG. 1B) of 5.0 inch external diameter; and the conventional joints 12 may be of a standard 18 inch length, with an external diameter of 6⅛ inch, an internal diameter of 3.8 inches. The conventional joints 12 are typically constructed of the same material as the pipe 11, which therefore is not impedance matched to the pipe sections, and are typically connected to pipe 11 by welds 14, which may be formed from materials, such as standard weld materials. The pipes 11 may vary in length from about 20–45 feet.

The present invention involves the modification of the joints 12 of FIG. 1 indicated in FIG. 1B at 12', and which, for example, are impedance matched to the conventional pipes 11. For example, with pipes 11 and upsets 13 constructed of steel, the joints 12' can be impedance matched to the upsets 13 by using joints composed of alloys of titanium or aluminum, for example. The titanium alloy may be Timetal 15-3 manufactured by Titanium Metals Corp. and the aluminum alloy may be a particulate reinforced metal matrix composite, such as 7090-25% SiC manufactured by DWA Composites, Inc. As shown in FIG. 1B, the impedance matched joint 12' is composed of two sections 15 and 16 having a threaded connection, generally indicated at 17. Also, the joints may be constructed of metal matrix composites and fiber reinforced alloys.

Figure 2A:
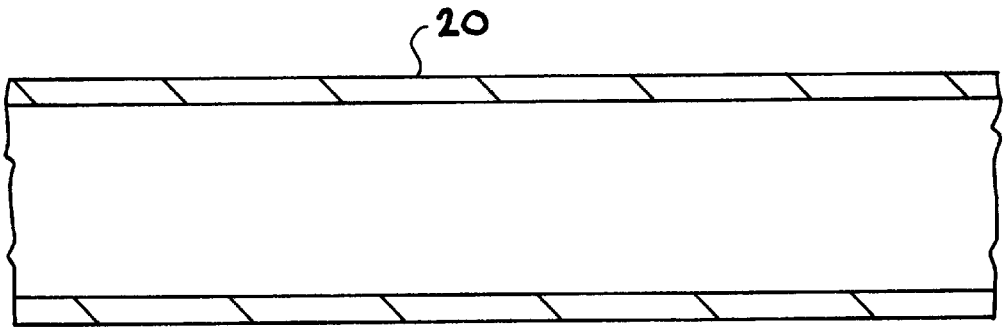
FIGS. 2A–2D illustrate in cross-section other drill string joint arrangements.
Figure 2B:
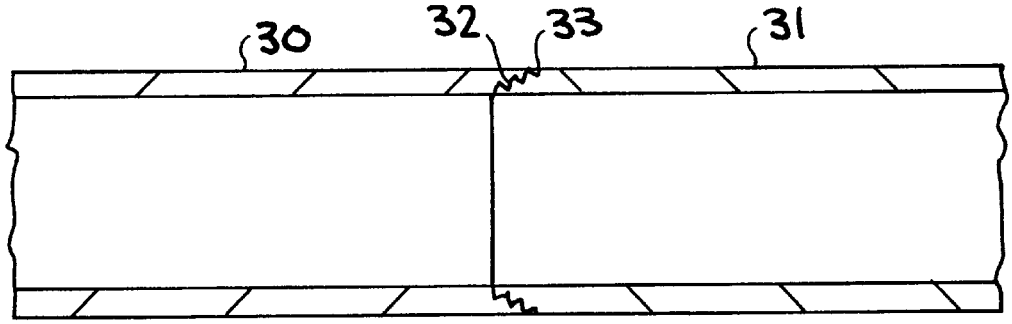
Figure 2C:
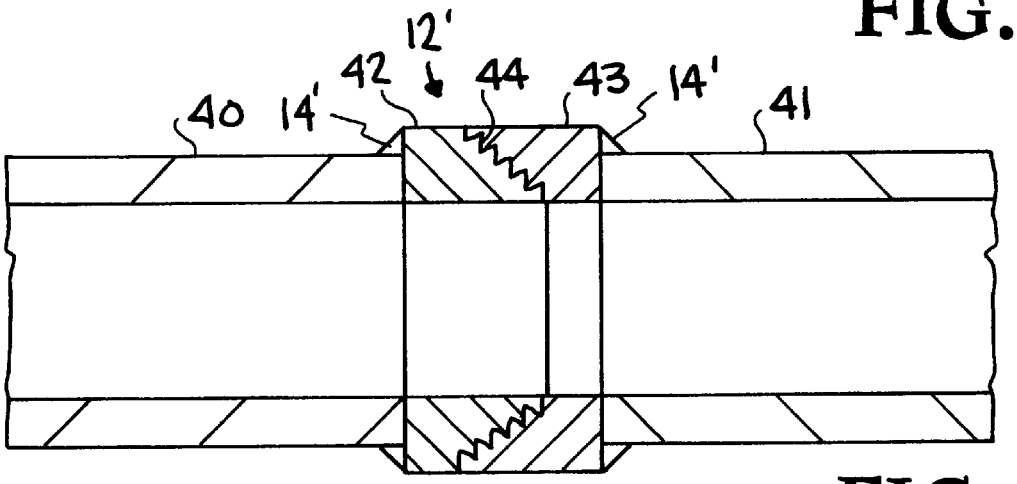
Figure 2D:
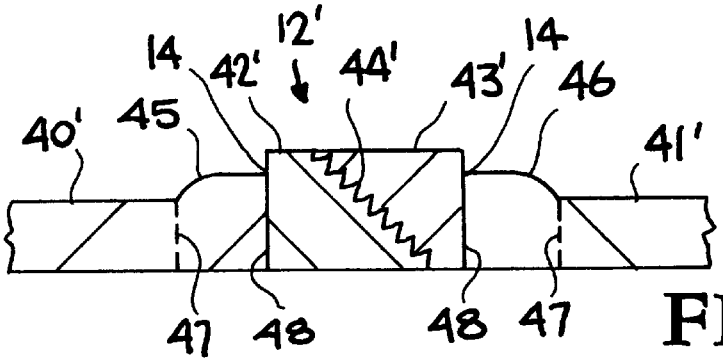

FIGS. 2A, 2B, 2C and 2D illustrate other embodiments of impedance matched pipe strings. FIG. 2A illustrates an end section of a coil tubing which may be of any desired length. The tubing 20 may be connected to a coupler or collar, not shown, for connection to a point of use. Should it be necessary to connect lengths of tubing, such can be done as shown in FIGS. 2B–2D so that there are no area or cross-section change as in FIG. 2B or such are impedance matached as in FIGS. 2C and 2D.

FIG. 2B illustrates an impedance matched pipe string composed of pipe sections, two shown at 30 and 31, interconnected by male and female threads 32 and 33. The pipe sections need be thick enough to maintain the threaded coupling. Since the pipe sections are of the same material, such as steel or a titanium alloy, and of the same wall thickness, the pipe sections and the threaded connection are essentially one piece, they are impedance matched, and the acoustic signal only sees a single long piece of pipe, and consequently the wave travels without reflection.

FIG. 2C illustrates an embodiment of a pipe string wherein the thickness of the pipe sections is uniform along the length of each section. A joint is located at the ends of adjacent pipe sections which is increased in thickness to accommodate a threaded coupling. For example, the entire pipe section may have a thickness of the upset region 13 of a conventional pipe section, as shown in FIG. 1B. The only impedance mismatch would occur at the pipe-joint interfaces. As shown, pipe sections 40 and 41 are interconnected by an enlarged diameter joint 12' composed of male and female threaded ends 42 and 43 to provide a threaded interconnection 44. The joint 12' may be constructed of impedance matching materials. The pipe sections 40 and 41 are secured to joint 12' as by welding, indicated at 14', or by bonding, epoxy, etc. By impedance matching the joint ends 42 and 43 to the pipe sections 40 and 41 results in an arrangement for which acoustic wave transmission would be nearly perfect, as in FIG. 2B.

FIG. 2D illustrates an embodiment generally similar to FIG. 2C for connecting pipes with conventional upset ends. As shown, pipe sections 40' and 41' have upset end sections 45 and 46 which are secured to a joint 12' having end sections 42' and 43' and which are threaded to provide an interconnection 44'. The joint 12' may be secured as indicated at 14 to upsets 45 and 46 as by welding, bonding, or epoxying. For standard pipes and joints composed of the same material, wave reflections occur at the pipe 40' or 41'/upset 45 or 46 regions indicated at dash lines 47 and at the upsets 45 and 46/joint 12' regions indicated at interfaces 48. Impedance matching the joint 12' to the upsets 45 and 46 removes reflections at regions 48 and thus the only reflections are in regions 47.

The improvement in signal transmission is dramatic when the invention is utilized. For example, consider a conventional 4.5 inch internal flush (IF) external upset jointed pipe (not impedance matched) as an illustration of the invention. Here, a uniaxial stress wave of unit amplitude in a pipe will initially have an amplitude of 0.79 in an adjacent pipe, due to the impedances of the upset-joint-upset traversal. A transmission amplitude of 0.91 is obtained if the joint is impedance matched to the upset. The net effect is that a signal propagated through many joints of standard drill pipe will be attenuated and time delayed significantly, as compared to the same signal propagated through impedance matched pipe.

Figure 3A:
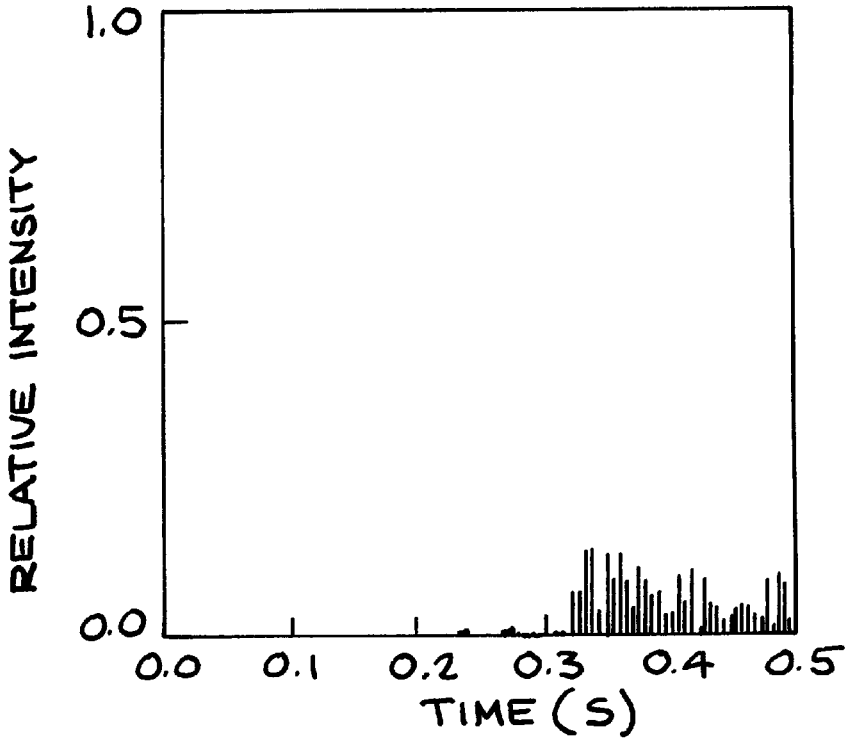
FIGS. 3A and 3B graphically illustrate the results of numerical simulations of a signal propagated through 1 km of standard jointed pipe (FIG. 3A) and impedance matched jointed pipe (3B).
Figure 3B:
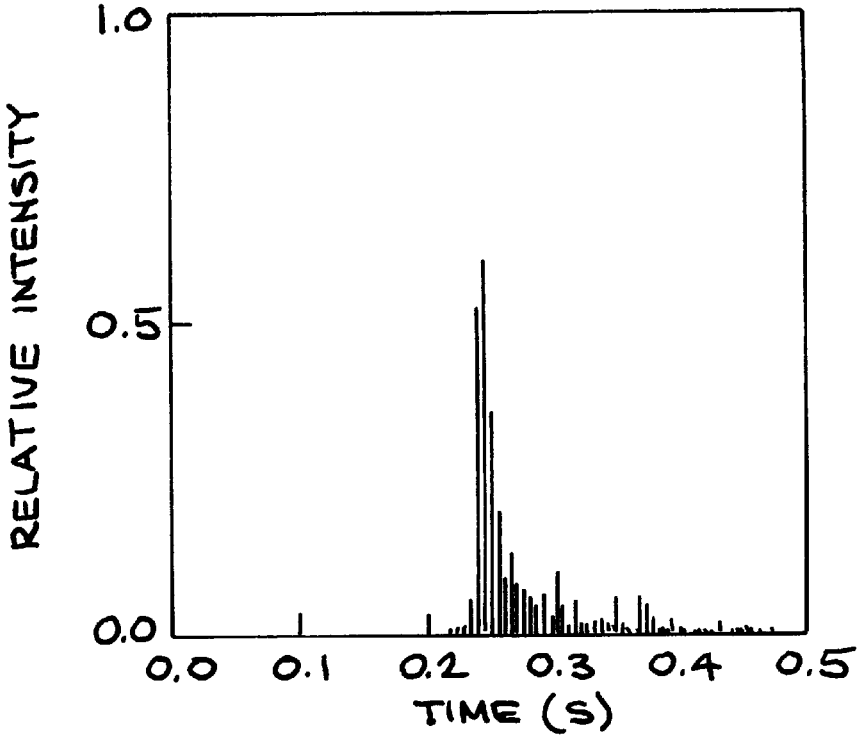

FIGS. 3A–3B shows the results of numerical simulations of a signal propagated through 1 km of standard jointed pipe, like FIG. 2D which is all steel (see FIG. 3A), and impedance matched jointed pipe, like FIG. 2D, but with the joint impedance matched to the upset (see FIG. 3B). The driving signal shown is 5 cycles of a 1 kHz sinusoid, which is in the passband region for both pipe structures, and represents, for example, 1 bit of data.

FIGS. 3A–3B show the relative intensities 1 km (175 joints) from the source. Relative intensity equals (mass velocity at 1 km)$^2$/ (mass velocity at source)$^2$. In order to maximize the total number of bits that can be received per second, the received signal should be attenuated and dispersed temporally as little as possible and it must also have a well defined signature, so it can be identified unambiguously. The results shown in FIGS. 3A–3B were obtained using an elastic model, the propagation was lossless. Typical losses in a drill string are 3 db/1000 ft.

Figure 4A:
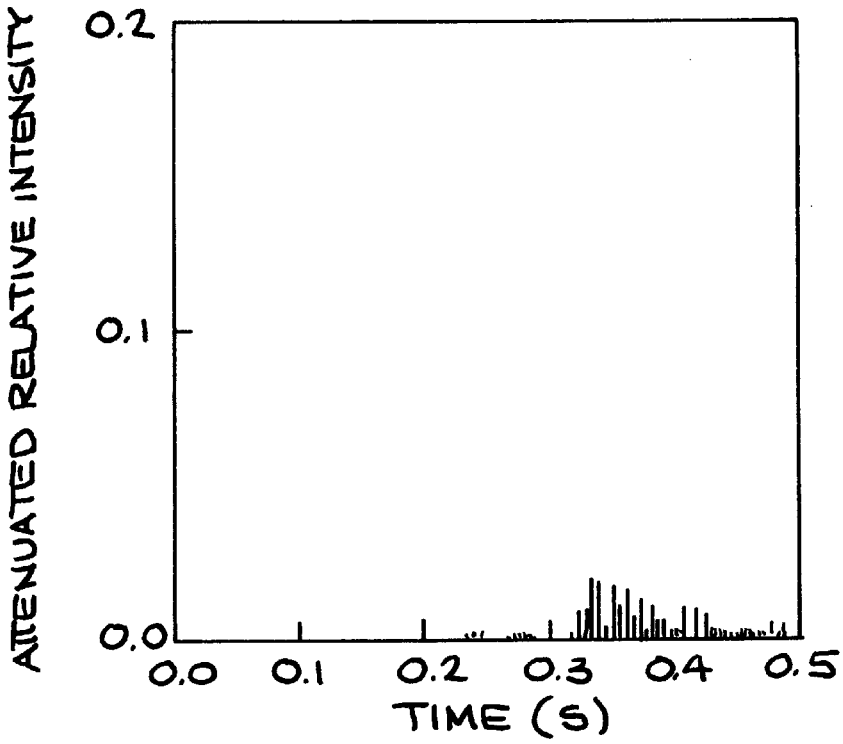
FIGS. 4A and 4B show the data in FIGS. 3A and 3B modified to account for attenuation losses in a standard jointed pipe.
Figure 4B:
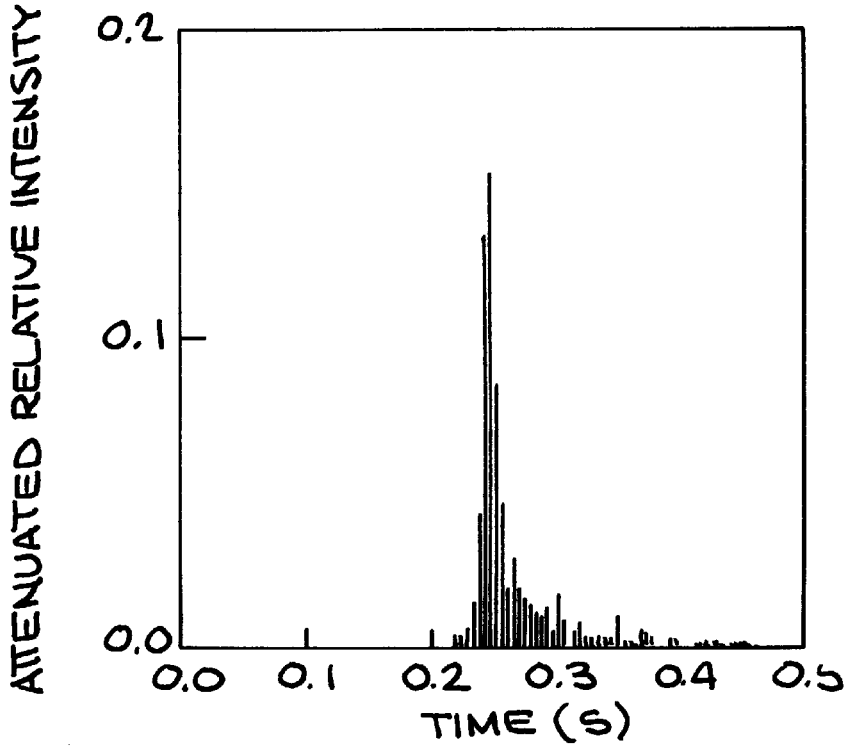

FIGS. 4A–4B show the calculation in FIGS. 3A–3B modified to account for this attenuation (3 db/1000 ft.~49.2 db/sec for a linear wave traveling at 5 km/sec.). The signal in the impedance matched jointed pipe (FIG. 4B) has more than 7 times the amplitude of the standard jointed pipe (FIG. 4A).

Figure 5A:
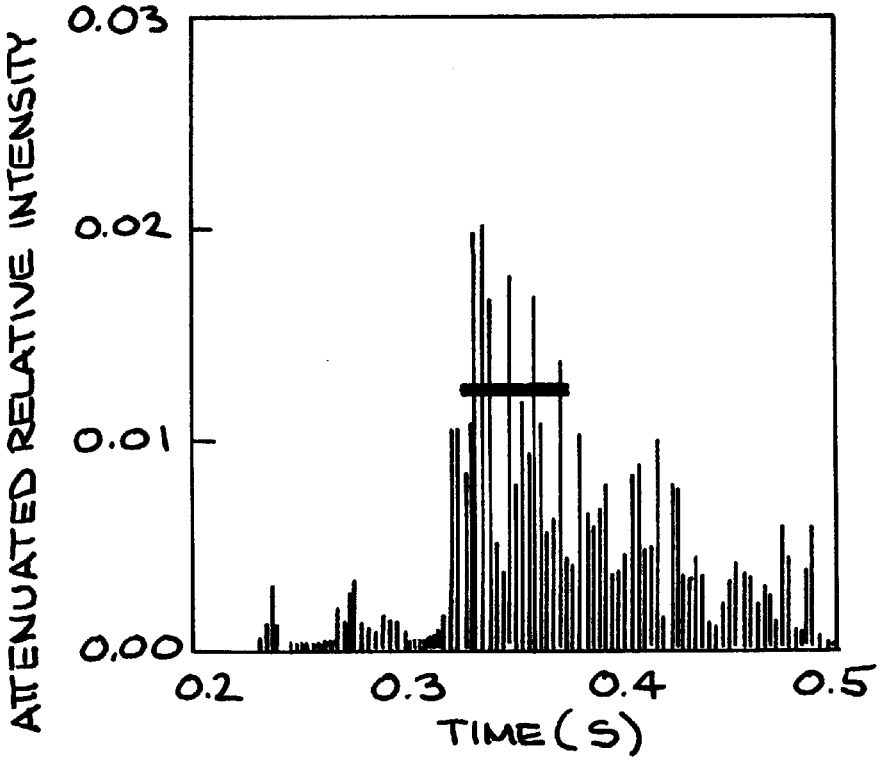
FIGS. 5A and 5B show expanded views of FIGS. 4A–4B.
Figure 5B:
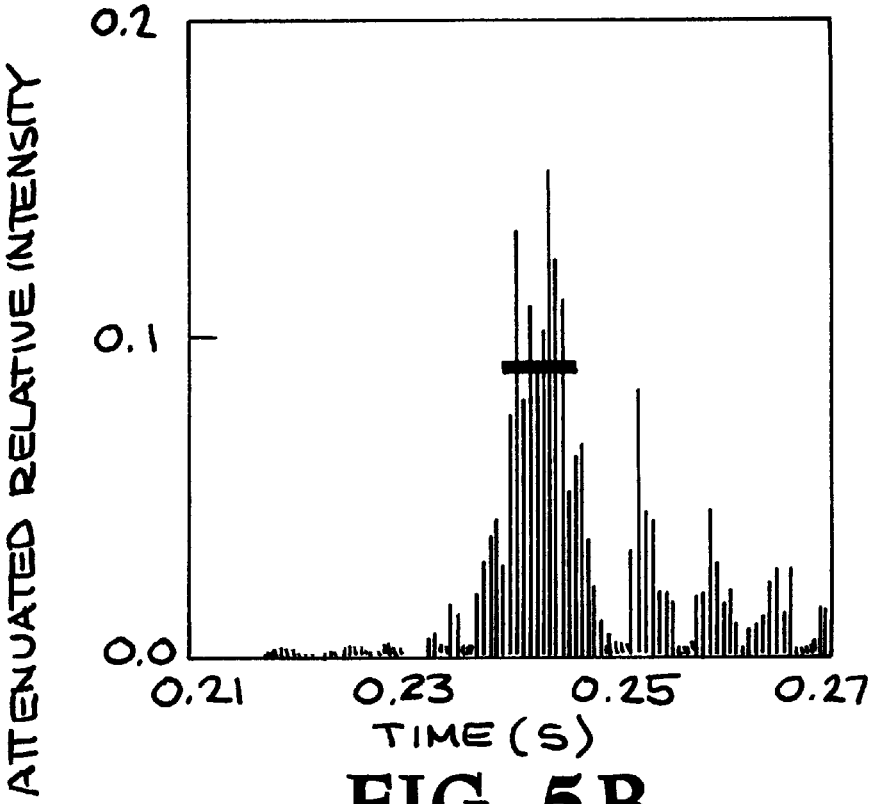

FIGS. 5A–5B show expanded views of FIGS. 4A–4B. As shown in FIG. 5A, the standard jointed pipe produces a signal that has a low amplitude, is dispersed greatly in time, and consequently requires 50 ms to identify unambiguously (indicated by the reception of a signal with amplitude greater than that indicated by the solid horizontal bar). By comparison, the signal in the impedance matched jointed pipe (FIG. 5B) has a large amplitude that can be unambiguously (indicated by the solid horizontal bar) identified within 7 ms, which is only 2 ms greater than the 5 ms input signal. These results indicate that data transmission rates exceeding 50 bits/sec may be achievable using impedance matched jointed drill pipe and a simple detection system that discriminates bits using an intensity threshold for the received signals.

Figure 6:
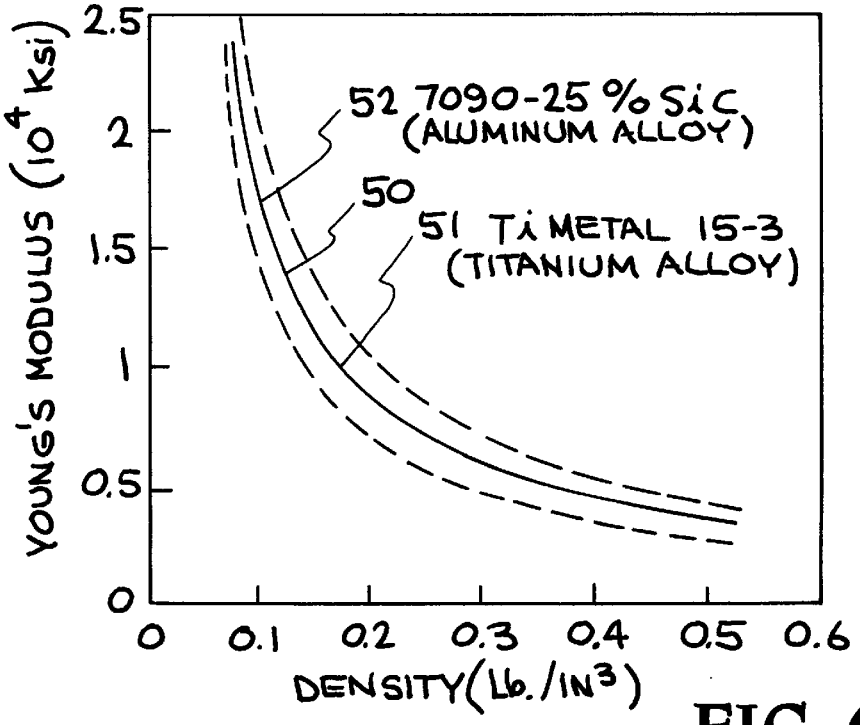
FIG. 6 shows the Young's modulus as a function of density for impedance matching a joint to 4.5" IF external upset steel drill pipe.

The construction of impedance matched jointed pipe requires finding a joint material and geometry that has the same impedance as the region to which it is joined, in this case the upset region. The impedance is defined as the product of the density, solid area, and uniaxial stress sound speed. Since the joint sizes are standardized, only the density and sound speed are adjustable. The solid line indicated at 50 in FIG. 6 shows the combinations of Young's modulus and density that are required to impedance match a joint to a 4.5 inch IF external upset steel pipe. Points within the dashed lines are within ±10% of the required acoustic impedance. By way of example, it has been found that two alloys (titanium or aluminum), such as titanium alloy Timetal 15-3 indicated at 51 and 7090-25% SiC (aluminum alloy) indicated at 52, illustrated in FIG. 6 have thermal, mechanical, and machinability/bonding properties that are compatible with the standard steel pipe. While verification of other impedance matchable materials for steel pipe have not been fully carried out, other materials such as other Ti alloys or aluminum alloys appear to provide an adequate improvement over the conventional jointed pipe signal transmission.

While the description of the invention has been directed to the use of steel pipe and associated joints in a drill string, impedance matching can be carried out in other types of joints for interconnecting components, both hollow and solid, and composed of other materials, where it is desired to transmit a signal via the interconnected components.

It has thus been shown that the invention provides a method for impedance matching jointed components, and an impedance matched jointed drill pipe string for improved acoustic transmission. Thus, the present invention provides a primary component for developing a commercially viable high date rate MWD system, and has numerous applications including well logging, directional drilling, drilling dynamics, and spectroscopy while drilling boreholes.

While particular embodiments, materials, parameters, etc. have been described and/or illustrated to exemplify and teach the principles of the invention, such are not intended to be limiting. Modifications and changes may become apparent to those skilled in this art, and it is intended that the invention be limited only by the scope of the appended claims.

What is claimed is:

1. In a measurement while drilling method, the improvement comprising:

impedance matching of joints and drill pipe of a jointed drill pipe string wherein the material of the joint is different from the material of the drill pipe.

2. The improvement of claim 1, wherein the impedance matching is carried out by forming at least one joint from material having an impedance which matches the impedance of the drill pipe.

3. The improvement of claim 2, wherein the drill pipe is constructed of steel.

4. The improvement of claim 2, wherein the at least one jointed drill pipe includes joints constructed of material selected from the group consisting of titanium alloys, aluminum alloys, metal matrix composites, particulate reinforced metal matrix composites, and fiber reinforced alloys.

5. The improvement of claim 2, wherein the drill pipe is composed of steel, and additionally including forming the at least one joint from material selected from the group consisting of titanium alloys and aluminum alloys.

6. The improvement of claim 5, wherein the titanium alloys include Timetal 15-3.

7. The improvement of claim 5, wherein the aluminum alloys include 7090-25% SiC.

8. A method of improving signal transmission in a standard drill string having a plurality of pipes interconnected by joints, comprising:

replacing the joints in the drill string with joints of a material that is different from the material of the pipe wherein the joint and pipe are impedance matched acoustically to the end of one or more pipes to which it is connected.

9. The method of claim 8, wherein the acoustically impedance matched joints are constructed of material formed by determining combinations of Young's modulus, density and solid cross-sectional area that are required to impedance match a joint to a pipe, and determining the Young's modulus, density of materials and solid cross-sectional area that correspond to the combination of Young's modulus, density and solid cross-sectional area of the pipe to which the joint is to be connected.

10. The method of claim 8, additionally including forming a joint from material that has a combination of Young's modulus, density and cross-sectional area that corresponds to that of the pipe.

11. The method of claim 8, wherein the plurality of pipes are composed of steel, and additionally including forming the impedance matching joints from material selected from the group consisting of titanium alloys and aluminum alloys.

12. The method of claim 11, wherein the joints are constructed of material selected from the group of Timetal 15-3 alloy and 7090-25% SiC.

13. The method of claim 8, additionally including forming the joints to include a pair of sections having a thread interconnection.

14. The method of claim 8, wherein the joints are formed by threaded ends of the adjacent pipes.

15. The method of claim 8, wherein the pipes and joints are connected by welding, bonding, or epoxying.

16. The method of claim 8, wherein the joints are formed by enlarging at least the end sections of the pipes and providing threads therein for interconnection.

17. The method of claim 8, wherein the pipes are formed to have a thick wall sufficient to enable threading thereof.

18. The method of claim 8, wherein the pipes are formed to include enlarged end sections having a male or a female threaded section therein.

19. An impedance matched jointed drill pipe for acoustic transmission, comprising:

at least two pipes and at least one interconnecting joint;

said interconnecting joint being constructed from material that is different from the material of the pipes where the joint is impedance matched acoustically to the end of a pipe to which it is connected.

20. The jointed drill pipe of claim 19, wherein said at least two pipes are constructed of steel, and wherein said at least one interconnecting joint is constructed of materials selected from the group consisting of an aluminum alloy and a titanium alloy.

21. The jointed drill pipe of claim 20, wherein said aluminum alloy is composed of 7090-25% SiC, and wherein said titanium alloy is Timetal 15-3.

22. The jointed drill pipe of claim 19, wherein said at least one interconnecting joint includes sections having a threaded connection.

23. The jointed drill pipe of claim 22, wherein said sections of said joint are connected to a pipe by any one of the group consisting of welding, bonding, and epoxying.

24. The jointed drill pipe of claim 19, wherein each joint is connected to ends of two pipes by welding, bonding, or epoxying, and wherein said joint is impedance matched acoustically to the pipes to which said joint is connected.

25. The jointed drill pipe of claim 19, wherein each joint is connected to ends of two pipes having upsets by welding or bonding the joint to the upsets, and wherein the joints are impedance matched acoustically to said upsets.

* * * * *